United States Patent [19]

Doroslovac

[11] Patent Number: 4,589,663

[45] Date of Patent: May 20, 1986

[54] GEAR-BASED MECHANICAL PUZZLE

[76] Inventor: Slobodan Doroslovac, 2731 Smith Rd., Akron, Ohio 44313

[21] Appl. No.: 643,439

[22] Filed: Aug. 23, 1984

[51] Int. Cl.[4] ..... A63F 9/08

[52] U.S. Cl. ..... 273/155

[58] Field of Search ..... 273/153 R, 153 S, 155; 235/144 MG; 434/401

[56] References Cited

U.S. PATENT DOCUMENTS

| | | | |
|---|---|---|---|
| 329,269 | 10/1885 | Brown | 273/153 R |
| 1,046,633 | 12/1912 | Oliver | 235/144 MG |
| 4,468,033 | 8/1984 | Minami | 273/153 S |

FOREIGN PATENT DOCUMENTS

| | | | |
|---|---|---|---|
| 2076663 | 12/1981 | United Kingdom | 273/153 S |

*Primary Examiner*—Anton O. Oechsle

*Attorney, Agent, or Firm*—Oldham, Oldham & Weber Co.

[57] ABSTRACT

A mechanical puzzle which relies on intermeshed gears which must be rotated into alignment, either relative to each other or static markings, or both. The gears rotate substantially unison unless a cut-out or slip-spot on any of the gears is so aligned with the shaft of an intermeshed gear such that the intermeshed gear can rotate freely.

9 Claims, 9 Drawing Figures

GEAR-BASED MECHANICAL PUZZLE

TECHNICAL FIELD

The instant invention resides in the art of games and puzzles and, in particular, to mechanical puzzles with aligning gears. The invention utilizes an arrangement of intermeshed gears which must be rotated into relative alignment with each other or with static markings. Some of the gears have cutouts or slip-spots to permit other intermeshed gears to rotate freely.

BACKGROUND ART

Heretofore, it has been known that gears can be intermeshed in various combinations such that a plurality of gears can be made to turn in unison in any combination of ratios.

Additionally, it has been known that the teeth of one gear can be cut out such that when aligned with teeth on the shaft of a meshed gear, said meshed gear is no longer interlocked and can rotate freely.

It is known that gears have been used in many types of games, toys and puzzles. However, it is also believed that to date, no game, toy or puzzle has utilized the combination of spur gears, gear teeth cut-outs, alignment markings and intermeshing of gears to create a puzzle which requires a solver to align said gears in a specific manner where the gears are aligned relative to each other, static markings or both.

DISCLOSURE OF INVENTION

It is an object of this invention to provide a puzzle which utilizes gears which must be aligned such that markings on the gears align with static markings or markings on other gears, or both.

It is another object of this invention to permit some of the gears to rotate freely by providing teeth cut-outs or slip-spots in some of the intermeshing gears.

It is yet another object of this invention to provide a puzzle which is simple in design and construction yet difficult to solve.

It is still yet another object of this invention to utilize gears which are interlocked such that rotating one gear will rotate all gears in unison unless the cut-outs have been positioned such that some gears are not interlocked.

These and other objects of the invention are achieved by: a mechanical puzzle comprising a plurality of gears with markings wherein said gears have: first means for turning in unison; second means for aligning said markings or said gears with each other or with static markings, or both; and third means for disengaging some of said gears whereby cut-outs or slip-spots are provided on some of said gears such that when rotatably aligned with interlocked gears, said interlocked gears are permitted to rotate independently.

BRIEF DESCRIPTION OF DRAWINGS

For a more detailed description and a better understanding of the invention, reference should be made to the drawings wherein.

BEST MODE FOR CARRYING OUT THE INVENTION

The instant invention may take on a multitude of forms. Fundamentally, the invention consists of any apparatus which is comprised of an arrangement of intermeshing gears, some of which may be disengaged through various slip-spots or cut-outs of the teeth on some gears, but which otherwise turn substantially in unison; and on which marks are placed which must be aligned with either the marks on other gears or static markings to be considered a solved puzzle. The gears are almost wholly visible to the puzzle solver. The arrangement of the gears may take on any shape or form from a square arrangement wherein a larger center gear is surrounded by four smaller gears, to a linear arrangement wherein several gears are in a line, to a circular arrangement wherein the gears form a circular and finally to a back-to-back arrangement wherein a number of gears are arranged in an inverted fashion such that two puzzle faces or fronts are formed, both faces interlocked such that both must be solved together.

The preferred embodiments of the invention are more readily perceived by directing attention to the figures wherein three arrangements are shown.

Figure 1:
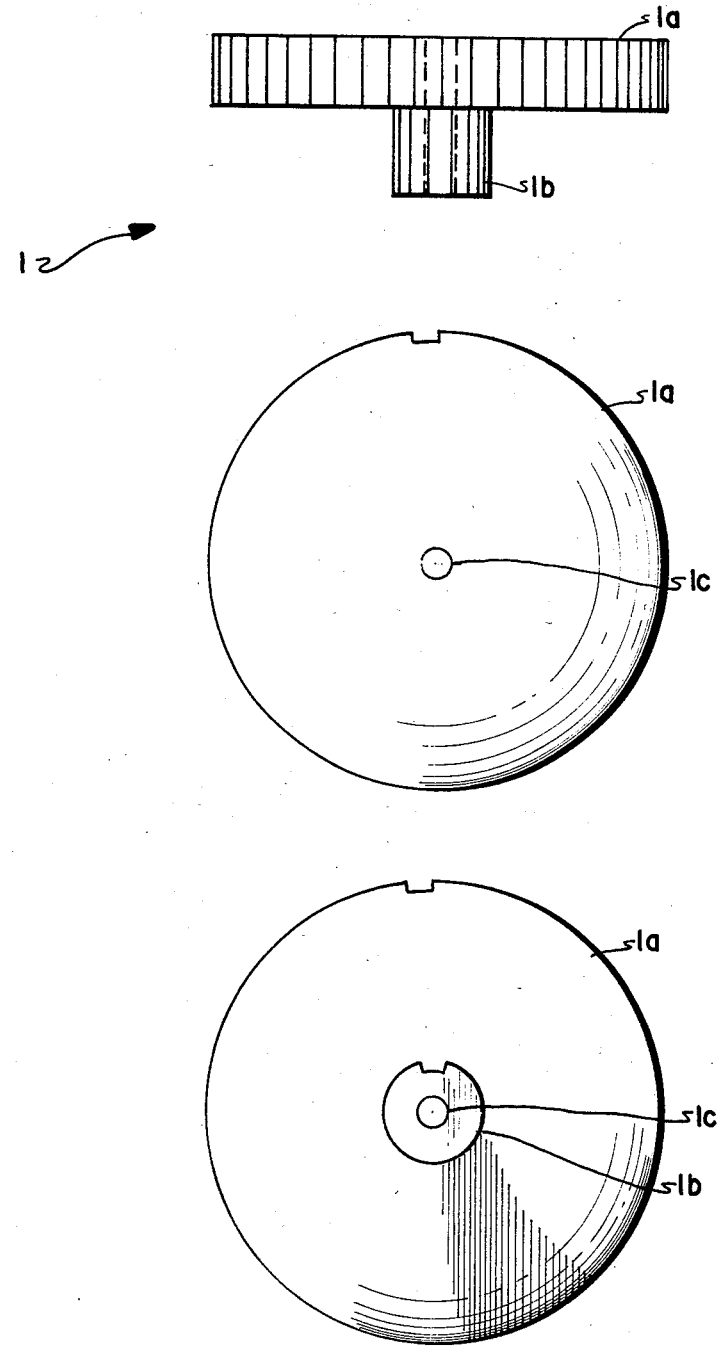
(PRIOR ART) FIG. 1
FIG. 1 shows a prior art spur gear utilized in the invention.

FIG. 1 shows a typical prior art spur gear used in the instant preferred embodiments. The gear is indicated generally by the numeral 1 and comprises wheel portion 1*a*, shaft portion 1*b* and shaft hole 1*c*. For the purposes of simplicity in all of the remaining figures, all gears will have associated with them a number and their various portions will be indicated by that numeral and a letter. Thus, the gears will be referred to either by their general designation or by their various portions interchangeably. And, although no specific reference is made to a gear portion, such portion can be assumed to be present unless it is specifically excluded in the descriptions presented hereinafter.

Figure 2:
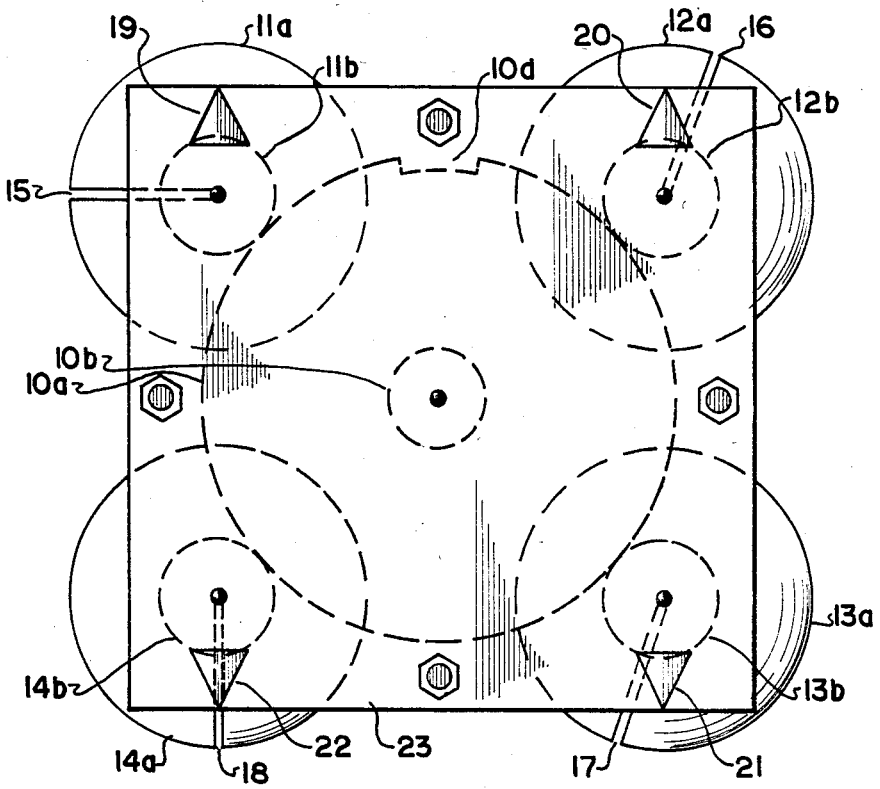
FIG. 2 shows a front view of a puzzle utilizing a square arrangement of gears.
Figure 3:
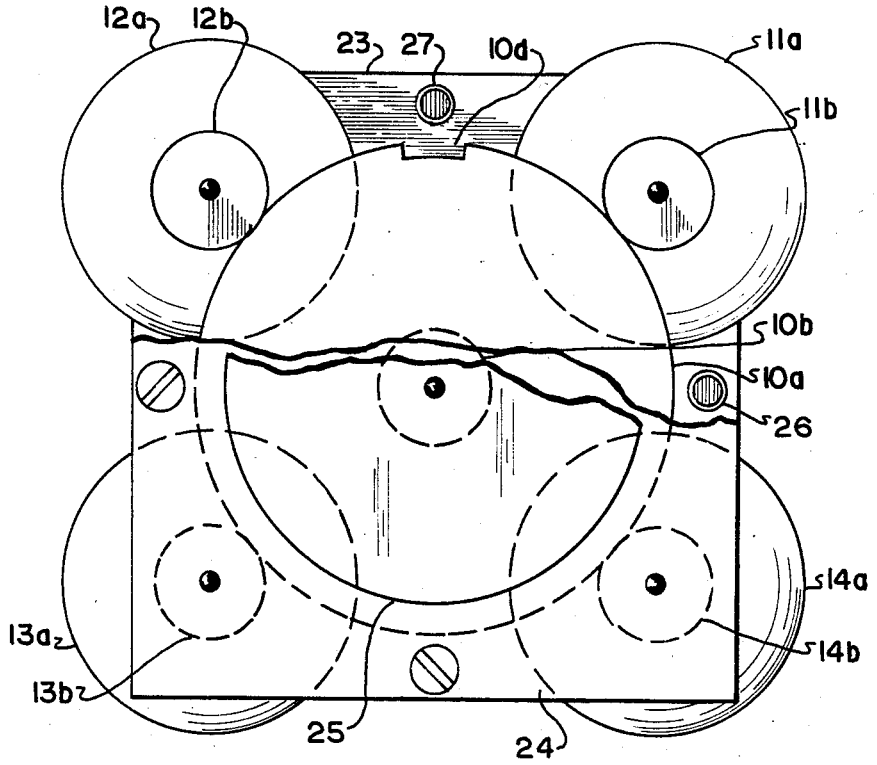
FIG. 3 shows a back view of a puzzle utilizing a square arrangement of gears.
Figure 4:
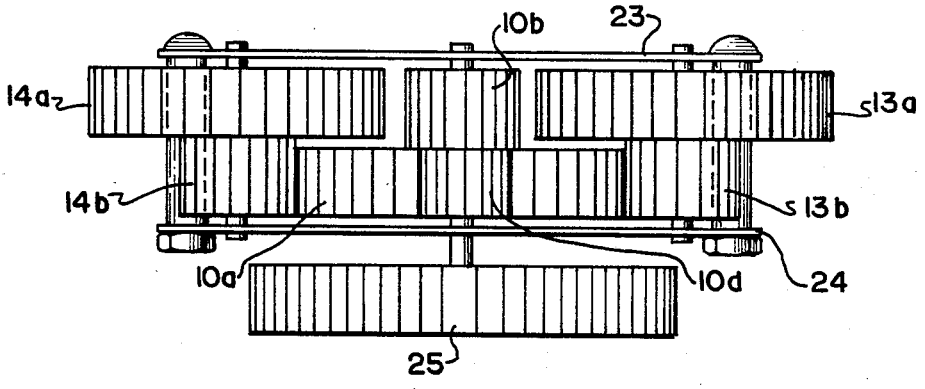
FIG. 4 shows a side view of a puzzle utilizing a square arrangement of gears.

FIGS. 2, 3 and 4 show a preferred embodiment which utilizes a square arrangement of gears. The invention is comprised substantially of gears 10 through 14. Gear 10 occupies a central location and the remaining gears are located at the four corners of a square. The wheel portion, 10*a* is intermeshed with the shaft portions 11*b* through 14*b* of the remaining gears. Thus, rotating any gear will cause all gears to rotate in unison. However, cut-out or slip-spot 10*d* can be rotatably aligned with any of shaft portions 11*b* through 14*b* such that one of gears 11 through 14 may rotate independently of the rest.

As can be seen most clearly in FIG. 4, gear 10 is mounted inverted with respect to the other geas. This allows for a reduced overall thickness of the puzzle and permits high gear ratios between shaft portions 11*b* through 14*b* and wheel portion 10*a*.

The gears 10 through 14 are all mounted on shafts (not shown) and are sandwiched between front plate 23 and back plate 24. The plates are separated by spacers, of which only two, 26 and 27 are made of a clear, transparent plastic to allow the solver to see the gears and the markings 15 through 18 located on the gears.

The instant embodiment depicts an arrangement wherein the solver must align markings on the gears with static markings. Thus, front plate 23 contains static markings 19 through 22 with which markings 15 through 18 must be aligned, respectively.

A knob 25 is located on the end of the shaft to which center gear 10 is mounted to permit the solver to turn gear 10 without having to insert his or her fingers into the puzzle mechanisms. The knob is located on the back side of the puzzle above back plate 24.

Figure 5:
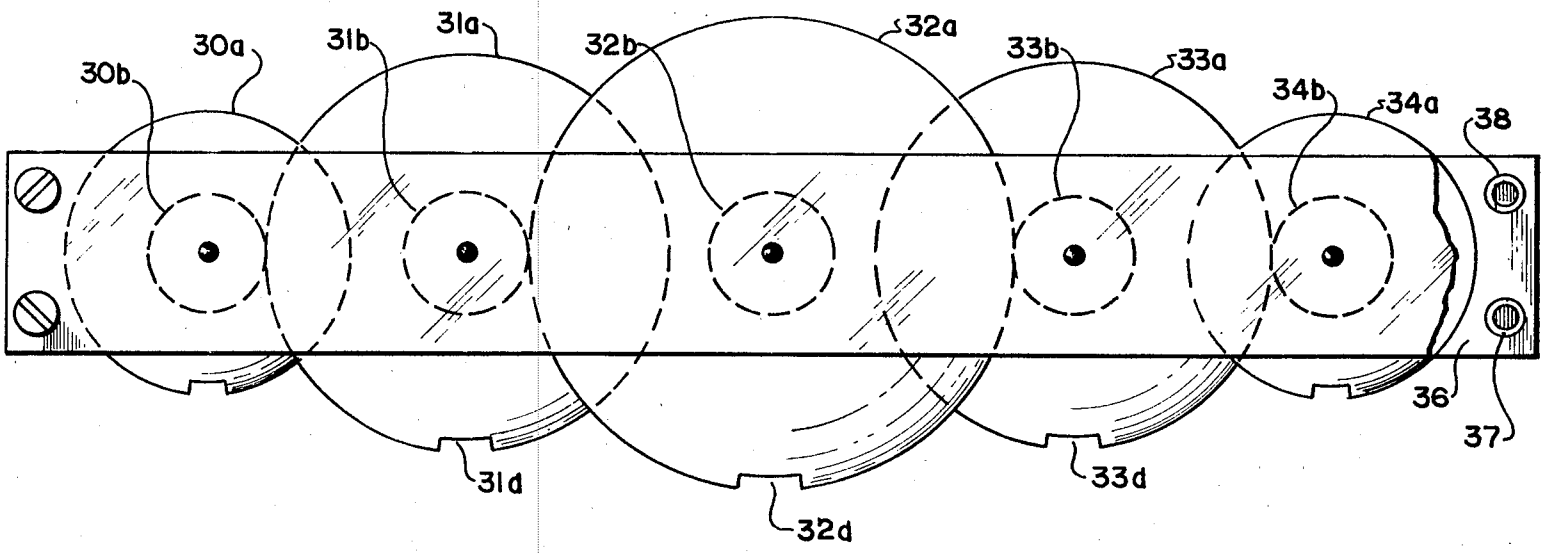
FIG. 5 shows a front view, without markings of a puzzle which utilizes a linear arrangement of gears.
Figure 6:
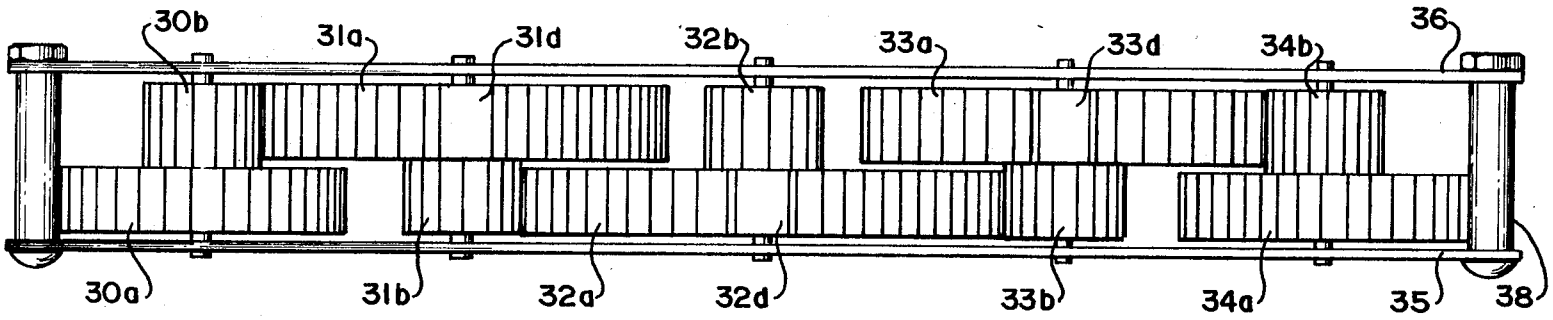
FIG. 6 shows a side view of a puzzle which utilizes a linear arrangement of gears.

FIGS. 5 and 6 show another preferred embodiment which utilizes a linear arrangement of gears. The apparatus shown is substantially comprised of gears 30 through 34. Gear 32 is the largest of the five gears shown and is located in the center. In turn, gears 31 and 33 are the next largest gears and are located on either side of gear 32. The remaining gears 30 and 34 are placed on either end of the linear arrangement.

As can be easily seen in FIG. 6, the gears are arranged in alternatingly inverted fashion such that each gear is inverted with repect to those on either side. Thus, shaft portion 30*b* intermeshes with wheel portion 31*a*. In turn, shaft portion 31*b* intermeshes with wheel portion 32*a* which intermeshes with shaft portion 33*b*. In turn, wheel portion 33*a* intermeshes with shaft portion 34*b*.

Cut-outs or slip-spots 31*d* through 33*d* are provided to allow any of gears 31 through 34 to rotate independently.

The gears are mounted similarly to those in FIGS. 2 through 4. The gears are mounted on shafts (not shown) and sandwiched between a front plate 35 and a back plate 36. The plates are made of clear plastic. Additionally, the plates are separated by spacers of which only two, 37, and 38 are shown.

Figure 7:
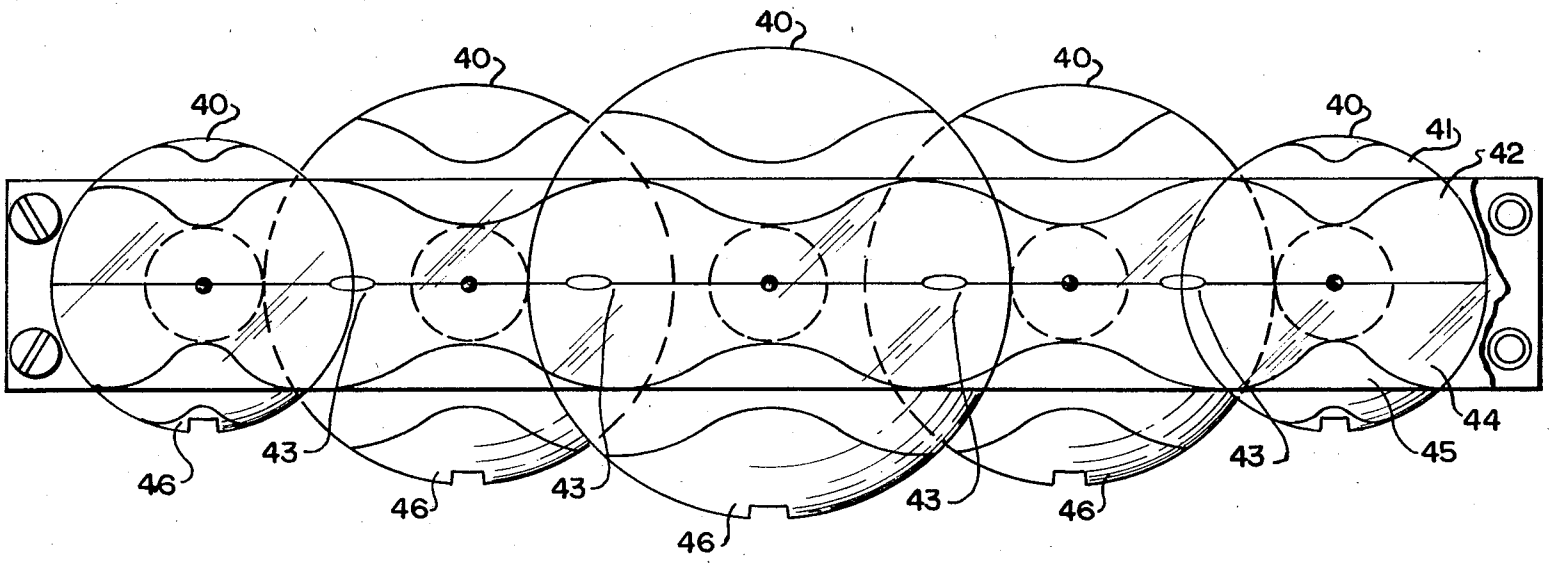
FIG. 7 shows a front view of the puzzle in FIG. 5 with the markings which consist of wavy color bands.
Figure 8:
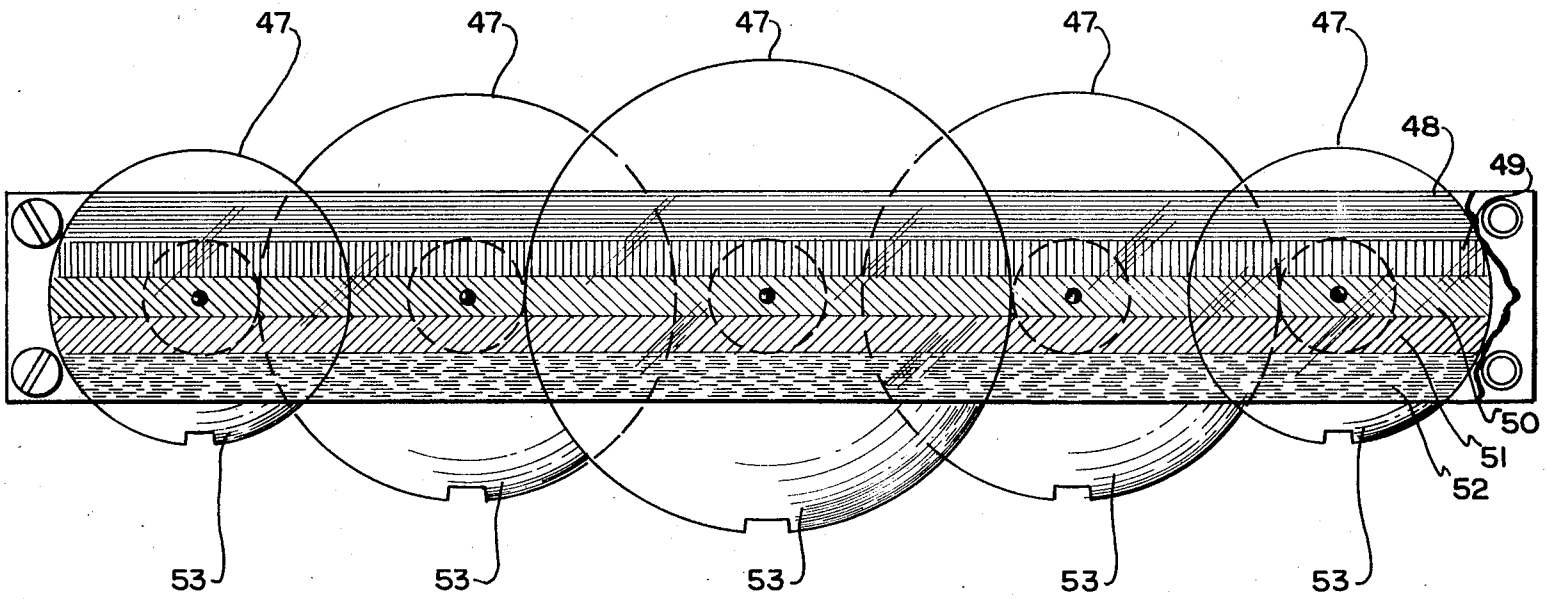
FIG. 8 shows a front view of the puzzle in FIG. 5 with markings which consist of straight color bands.

FIG. 5 does not show any markings because two schemes are shown in FIGS. 7 and 8. Therefore, reference should now be had to FIGS. 7 and 8 for those schemes.

FIG. 7 shows a marking scheme which utilizes a pattern of wavy color bands. Utilizing such markings, the puzzle is solved by aligning the gears relative to one another rather than to static markings.

For the purposes of illustration, seven color bands are depicted in FIG. 7. The bands are designated 40 through 46 with band 43 being almost negligible. The coloring of the bands is unimportant as long as the bands in at least one set of the bands, both equidistant from the center of the gears are not the same color. This dissimilarity of colors will avoid any problems with 180 degree misalignment.

FIG. 8 merely shows bands 47 through 53 to depict an arrangement of straight parallel bands.

Figure 9:
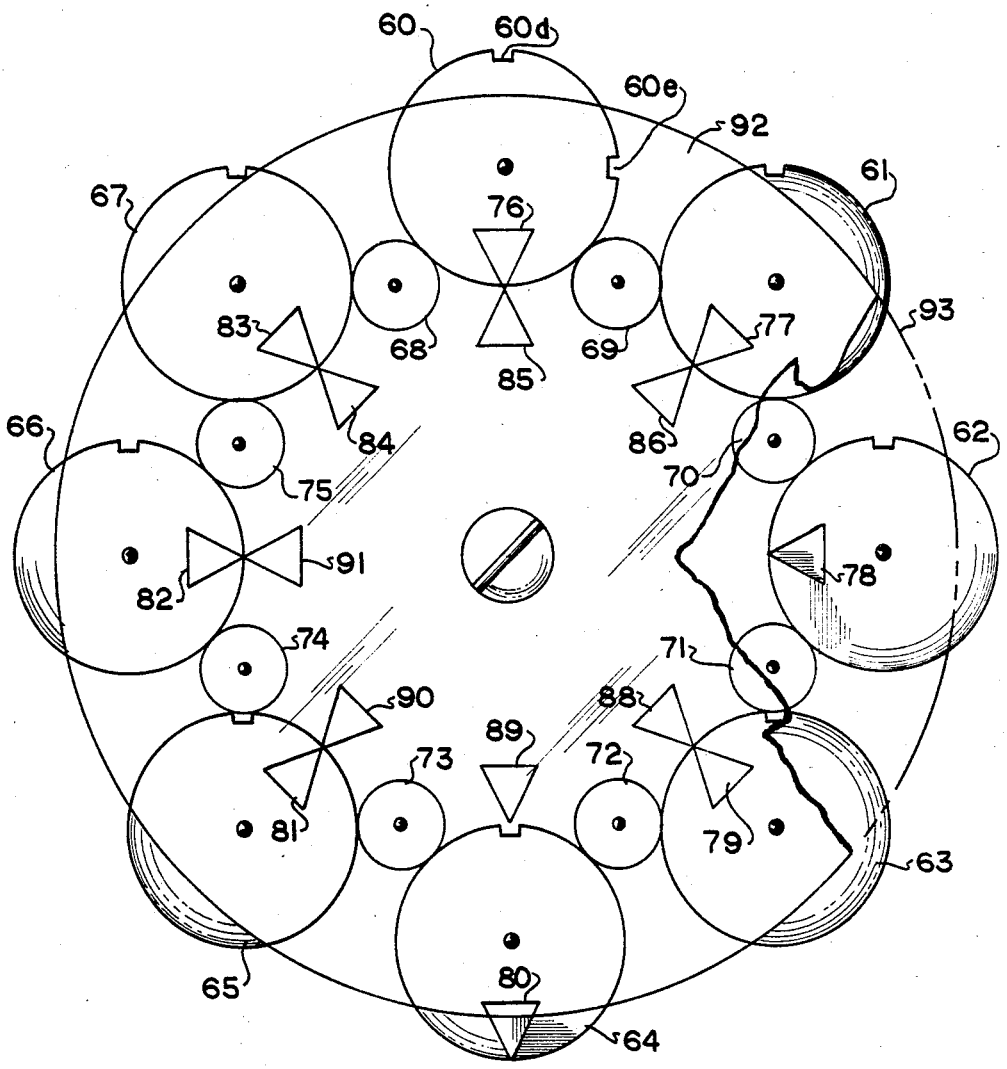
FIG. 9 shows a front view of a puzzle utilizing a circular arrangement of spur gears and spindle gears.

FIG. 9 shows a third embodiment of the invention which utilizes a circular arrangement of gears. The embodiment comprises substantially gears 60 through 75. Gears 60 through 67 comprise only the wheel portion 1*a* of the gear 1 shown in FIG. 1. Gears 68 through 75 comprise only the shaft portion 1*b* of the gear 1 shown in FIG. 1. However, the operation of this embodiment is exactly the same as those previously presented.

The gears 60 through 75 are mounted on shafts (not shown) and sandwiched between clear plastic front plate 92 and back plate 93. Both faces of this embodiment could be exactly the same or back plate could be opaque.

The embodiment is shown with static markings 84 through 91 and gear markings 76 through 83. However, a scheme or pattern placed on the gears requiring relative alignment between the gear can easily be imagined and implemented.

An added feature of the embodiment in FIG. 9 is found on gear 60. Gear 60 necessarily contains two slip-spots or cut-outs 60*d* and 60*e*. Two slipspots are necessary, because otherwise none of the gears could be aligned with a slip-spot so as to be allowed to rotate freely.

While in accordance with the patent statutes, a preferred embodiment and best mode has been set forth in detail, the scope of the invention is limited solely by the scope of the appended claims.

I claim:

1. A mechanical puzzle comprising at least four flat gears with markings wherein:

said gears are disposed in the same or parallel planes and interlocked so as to turn in unison; and said puzzle has means for aligning said markings or said gears with each other, or with static markings or both; and said puzzle also has means for disengaging some of said gears, said disengaging means being in the form of cut-outs provided on at least one of each pair of interlocked gears such that when said cut-outs are rotatably aligned with adjacent gears, said adjacent gears will be out of physical contact and capable of independent rotation.

2. A mechanical puzzle as in claim 1, wherein said gears are housed and/or mounted between two face plates.

3. A mechanical puzzle as in claim 2, wherein said plates are comprised of a clear, transparent material.

4. A mechanical puzzle as in claim 1, wherein said gears are arranged in a square formation such that a large center gear is surrounded by four smaller gears.

5. A mechanical puzzle as in claim 1, wherein said gears are arranged in a linear formation such that all of the gears are aligned in a row.

6. A mechanical puzzle as in claim 1, wherein said gears are arranged to form a circular pattern.

7. A mechanical puzzle as in claim 1, wherein some of the gears are positioned in inverted fashion with respect to the others forming a twosided puzzle, all of said gears interlocked and turning substantially in unison.

8. A mechanical puzzle as in claim 1, wherein said gears are positioned in various positions such that a plurality of puzzle faces or sides are formed.

9. A mechanical puzzle as in claim 1, wherein said markings are comprised of a member of the group consisting of color bands, black and white bands and stripes and all shaped in any form.

* * * * *